US009695826B1

(12) United States Patent
Harmon

(10) Patent No.: US 9,695,826 B1
(45) Date of Patent: Jul. 4, 2017

(54) PITOT TUBE PUMP AND RELATED METHODS

(71) Applicant: James Harmon, West Jordan, UT (US)

(72) Inventor: James Harmon, West Jordan, UT (US)

( * ) Notice: Subject to any disclaimer, the term of this patent is extended or adjusted under 35 U.S.C. 154(b) by 894 days.

(21) Appl. No.: 13/931,229

(22) Filed: Jun. 28, 2013

Related U.S. Application Data

(60) Provisional application No. 61/665,549, filed on Jun. 28, 2012.

(51) Int. Cl.
*F04D 1/12* (2006.01)
*F04D 29/42* (2006.01)
*F04D 29/44* (2006.01)

(52) U.S. Cl.
CPC ..... *F04D 1/12* (2013.01); *F04D 29/426* (2013.01); *F04D 29/4293* (2013.01); *F04D 29/445* (2013.01)

(58) Field of Classification Search
CPC . F04D 1/12; F04D 5/002; F04D 5/003; F04D 5/007; F04D 29/426; F04D 29/4293; F04D 29/445; F05B 2240/33
USPC ..... 415/88, 89, 211.2
See application file for complete search history.

(56) References Cited

U.S. PATENT DOCUMENTS 1,914,919 A * 6/1933 Heermans ..... F04D 15/0022 116/147
2,810,346 A 8/1953 Lung
2,938,471 A 4/1960 Jacuzzi et al.
2,941,474 A 6/1960 Hall
2,987,002 A 6/1961 Schipper
3,063,377 A 11/1962 Stanley et al.
3,244,109 A * 4/1966 Barske ..... F04D 29/2255 415/206
3,291,051 A 12/1966 Ekey
3,692,426 A * 9/1972 Ryall ..... F04D 29/445 415/122.1
3,822,102 A * 7/1974 Erickson ..... F04D 1/12 415/104
4,218,176 A * 8/1980 Gawne ..... F01D 1/34 415/201
4,252,499 A 2/1981 Erickson
4,279,571 A 7/1981 Erickson
(Continued)

FOREIGN PATENT DOCUMENTS

EP 2037125 3/2009

*Primary Examiner* — Richard Edgar
*Assistant Examiner* — Jesse Prager
(74) *Attorney, Agent, or Firm* — Thorpe North & Western, LLP

(57) ABSTRACT

A centrifugal pump comprises a pump assembly, through which a fluid can be impelled. The pump assembly includes a fluid inlet and a fluid outlet, a fluid casing, and an impellor positioned within the fluid casing, the impellor being driven by a power source and being operable to generate fluid flow within the fluid casing from the fluid inlet to the fluid outlet. The pump assembly also includes a volute area formed on a periphery of the fluid casing, the volute area being operable to receive fluid pressurized by flow induced by the impellor. A pitot tube is positioned within the volute area, the pitot tube being operable to receive pressurized fluid from the volute area and pass the fluid through an outlet having an expanding geometry that increases the flow rate of the fluid as it passes through the outlet.

18 Claims, 7 Drawing Sheets

(56) References Cited

U.S. PATENT DOCUMENTS

| | | | | | |
|---|---|---|---|---|---|
| 4,421,457 | A * | 12/1983 | Yoshinaga | F04D 29/444 | 415/208.3 |
| 4,621,981 | A | 11/1986 | Lorett | | |
| 4,627,792 | A | 12/1986 | Jensen et al. | | |
| 4,674,950 | A * | 6/1987 | Erickson | F04D 1/12 | 415/80 |
| 4,767,281 | A | 8/1988 | Sailer | | |
| 4,820,131 | A | 4/1989 | Johnson | | |
| 5,100,289 | A | 3/1992 | Caoduro | | |
| 5,184,937 | A * | 2/1993 | Arakawa | F04D 29/428 | 415/206 |
| 2,700,338 | A | 1/1995 | Smith | | |
| 5,451,139 | A | 9/1995 | Tadiello | | |
| 5,458,467 | A | 10/1995 | Yuhasz | | |
| 5,474,418 | A | 12/1995 | Wessel et al. | | |
| 5,997,243 | A | 12/1999 | Shaw | | |
| 6,171,078 | B1 * | 1/2001 | Schob | A61M 1/101 | 417/420 |
| 6,220,832 | B1 | 4/2001 | Schob | | |
| 2005/0112007 | A1 * | 5/2005 | Demers | F04C 19/002 | 417/572 |
| 2010/0322761 | A1 * | 12/2010 | Hunjan | F04D 29/445 | 415/203 |

* cited by examiner

PITOT TUBE PUMP AND RELATED METHODS

PRIORITY CLAIM

This application claims priority to U.S. Provisional Application Ser. No. 61/665,549, filed on Jun. 28, 2012, which is hereby incorporated herein by reference in its entirety

BACKGROUND OF THE INVENTION

Field of the Invention

The present invention relates generally to the field of centrifugal pumps. More particularly, the present invention relates to such pumps that utilize a pitot tube.

Related Art

Many centrifugal pumps utilize pitot tubes to transport fluid under very high pressures. Examples of pitot tube pumps are disclosed in U.S. Pat. No. 3,776,658 to Erickson; U.S. Pat. No. 3,822,102 to Erickson, et al.; U.S. Pat. No. 4,183,713 to Erickson, et al.; U.S. Pat. No. 4,252,499 to Erickson and U.S. Pat. No. 4,279,571 to Erickson, which are each incorporated herein by reference to the extent they are consistent with the teachings herein.

Typically, pitot tubes installed within pumps include an elongated neck portion that is shaped to position the tip (or inlet) of the pitot tube near the periphery of a rotary casing within which an impellor is creating fluid flow. The tip of the pitot tube is generally positioned within the pump casing where the pressure and rotational velocity of the fluid are greatest.

While such pitot tube pumps have been used with some success, there are a number of problems associated with these conventional systems. For example, due to the rather awkward geometry of the neck of the pitot (which is typically necessary to position the tip of the pitot tube where desired), the body (or neck) of the pitot tube is subject to significant forces as the fluid flows over and around the body, which can lead to significant vibrational problems. In addition, it is often the case that the tip portion of the pitot tube becomes worn over time and must be replaced or refurbished. Removal of conventional pitot tubes often requires dismantling of the entire pump, which often requires removal of the pump from the system in which it is operating, which can lead to significant losses in down time, wasted labor hours, etc. Also, conventional pitot tubes often require very specialized mounting hardware and associated tools for mounting and removing the pitot tube from the pumps.

SUMMARY OF THE INVENTION

In accordance with one aspect of the invention, a centrifugal pump is provided that include a pump assembly, through which a fluid can be impelled. The pump assembly can include a fluid inlet and a fluid outlet, a fluid casing, and an impellor positioned within the fluid casing. The impellor can be driven by a power source and can be operable to generate fluid flow within the fluid casing from the fluid inlet to the fluid outlet. The pump assembly can also include a volute area formed on a periphery of the fluid casing, the volute area being operable to receive fluid pressurized by flow induced by the impellor. A pitot tube can be positioned within the volute area, the pitot tube being operable to receive pressurized fluid from the volute area and pass the fluid through an outlet having an expanding geometry that increases the flow rate of the fluid as it passes through the outlet.

Additional features and advantages of the invention will be apparent from the detailed description which follows, taken in conjunction with the accompanying drawings, which together illustrate, by way of example, features of the invention.

DETAILED DESCRIPTION

Figure 1:
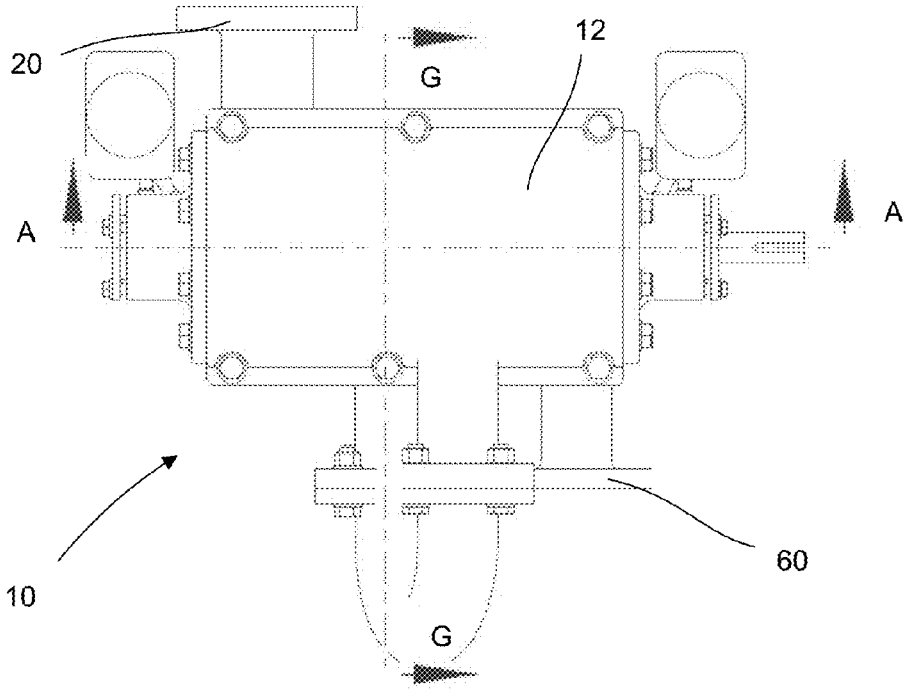
FIG. 1 illustrates an external view of a centrifugal pump in accordance with an embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

It is noted that, as used in this specification and the appended claims, the singular forms "a," "an," and "the" can include plural referents unless the context clearly dictates otherwise. Thus, for example, reference to "a pitot tube" can include one or more of such tubes.

Definitions

In describing and claiming the present invention, the following terminology will be used in accordance with the definitions set forth below.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the disclosure provided herein.

As used herein, relative terms, such as "upper," "lower," "upwardly," "downwardly," etc., can be used to refer to various components of the systems discussed herein, and related structures with which the present systems can be utilized, as those terms would be readily understood by one of ordinary skill in the relevant art. It is to be understood that such terms are not intended to limit the present invention, but are rather used to aid in describing the components of the present systems, and related structures generally, in the most straightforward manner.

As used herein, the term "substantially" refers to the complete or nearly extent or degree of an action, characteristic, property, state, structure, item, or result. As an arbitrary example, when an object or group of objects is/are referred to as being "substantially" symmetrical, it is to be understood that the object or objects are either completely symmetrical or are nearly completely symmetrical. The exact allowable degree of deviation from absolute completeness may in some cases depend upon the specific context. However, generally speaking, the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As an arbitrary example, an opening that is "substantially free of" material would either completely lack material, or so nearly completely lack material that the effect would be the same as if it completely lacked material. In other words, an opening that is "substantially free of" material may still actually contain some such material as long as there is no measurable effect as a result thereof.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 10 to about 50" should be interpreted to include not only the explicitly recited values of about 10 to about 50, but also include individual values and sub-ranges within the indicated range. Thus, included in this numerical range are individual values such as 20, 30.5, and 40 and sub-ranges such as from 10-30, from 20-40, and from 30-50, etc. This same principle applies to ranges reciting only one numerical value. Furthermore, such an interpretation should apply regardless of the breadth of the range or the characteristics being described.

It is noted that the figures are not necessarily drawn to scale. As such, various components of the invention may not be shown in correct proportion relative to one another. Also, in the interest of clarity, not all features of the invention are shown in each figure, even in the case where the example shown in the figure does include such features. As such, the figures should not be considered limiting, but are instead provided as examples of the various implementations of the present invention.

Invention

The invention relates generally to a centrifugal pump that includes a novel pitot tube arrangement that provides many advantages over conventional pitot tube pumps. These advantages include, without limitation, the ability to quickly and easily replace the pitot tube portion of the pump without requiring that the pump be dismantled, or removed from existing piping systems. The pitot tubes of the present invention are positioned such that vibrations resulting from fluid flow past the pitot tube are greatly reduced, if not avoided altogether. In addition, the design of the present invention allows the geometry of the pitot tube, and the area surrounding the pitot tube pickup, to be tailored to specific fluid applications.

Figure 2:
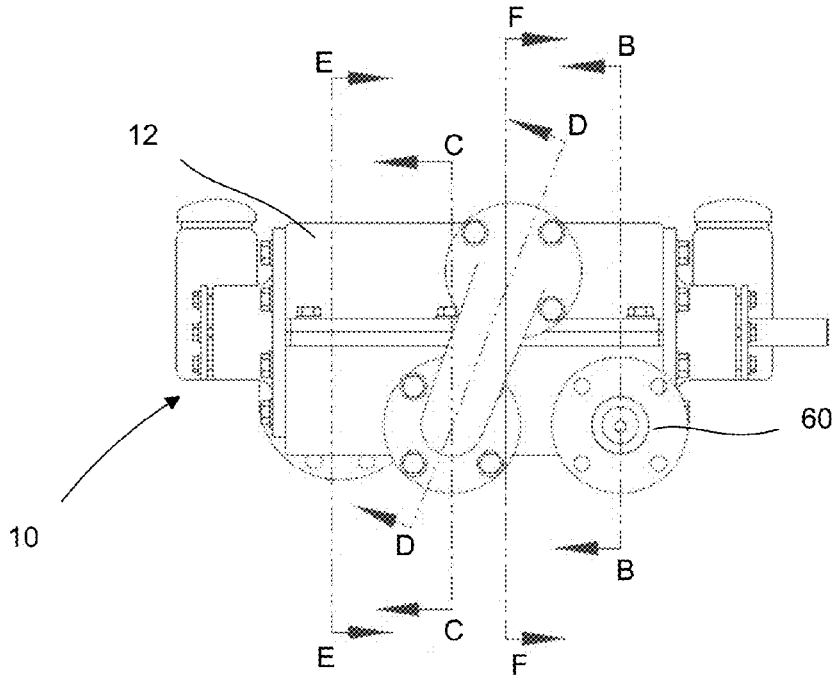
FIG. 2 illustrates a bottom view of the centrifugal pump of FIG. 1.
Figure 3:
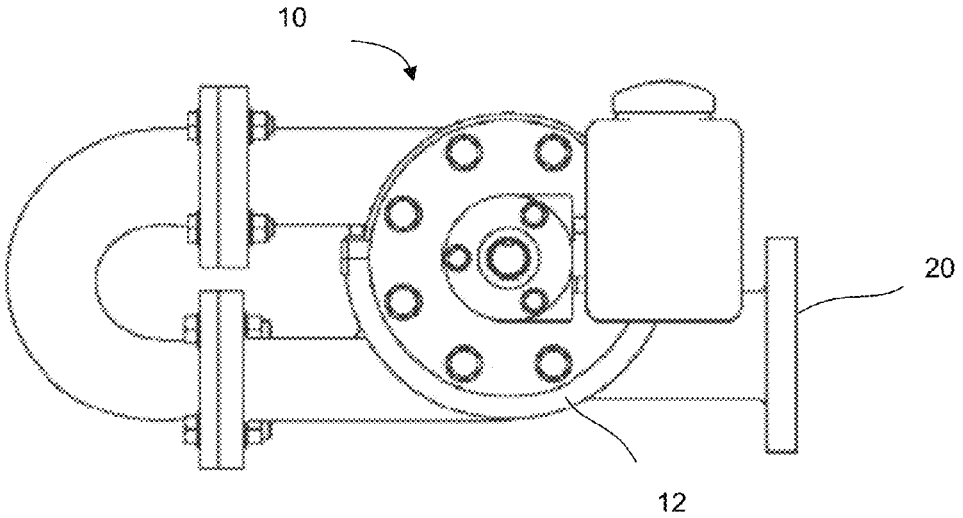
FIG. 3 Illustrates a side view of the centrifugal pump of FIG. 1.
Figure 4:
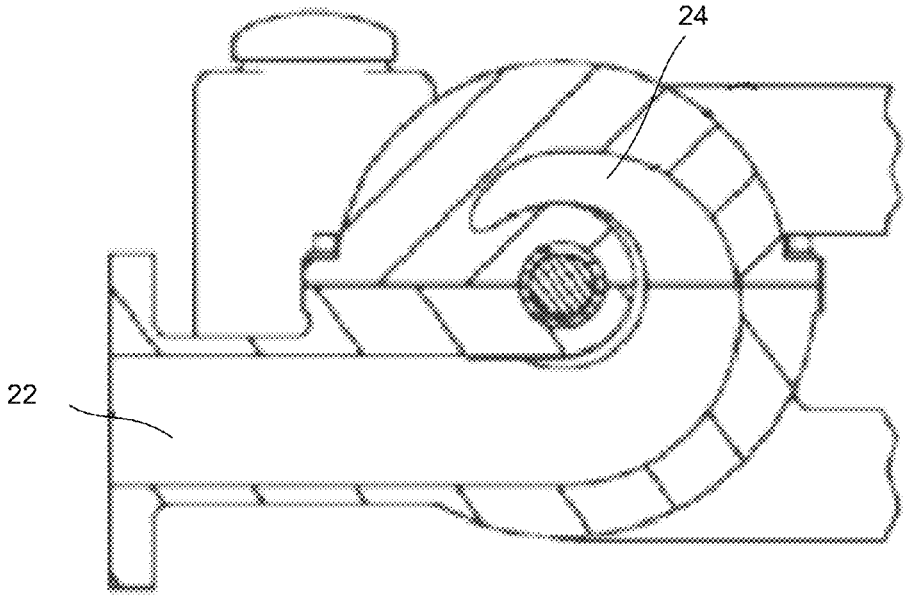
FIG. 4 illustrates a cross sectional view of the pump along section E-E of FIG. 2.

FIGS. 1-3 illustrate general concepts of the invention. FIGS. 1 through 3 illustrate outer portions of a pump assembly 10, while FIGS. 4 through 12 illustrate the various sections shown in FIGS. 1 through 3.

With general reference to the figures, in operation, fluid enters the pump through a manner that will be appreciated by one of ordinary skill in the art. For example, fluid can enter the pump via pipes or conduits connected to flange 20. The fluid can then be routed into a fluid casing 12 which houses an impeller 24 (first shown in FIG. 5). The fluid can then be directed through the fluid casing 12 to the inlet 22 or suction side of the impeller 24 through common methods. The impeller pressurizes the fluid and discharges the fluid from the fluid casing 12 through the outlet piping and flange 60 (FIG. 1).

Figure 5:
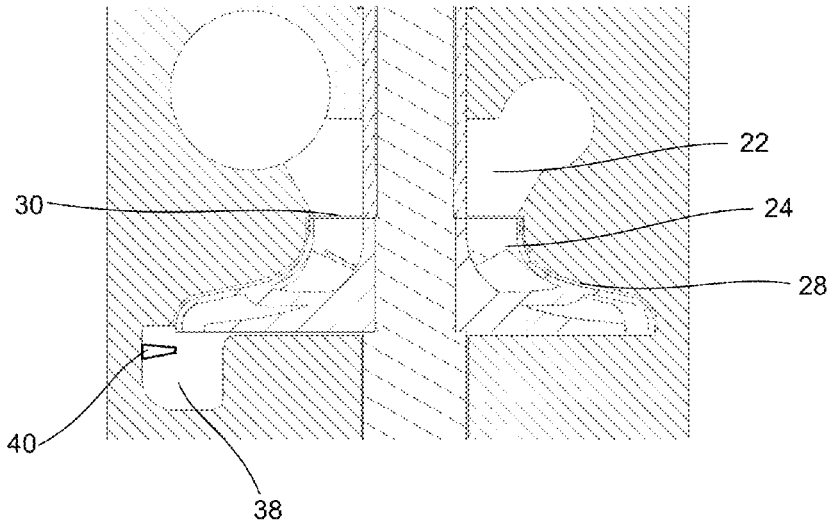
FIG. 5 illustrates a partial cross sectional view of the pump along section A-A of FIG. 1.
Figure 6A:
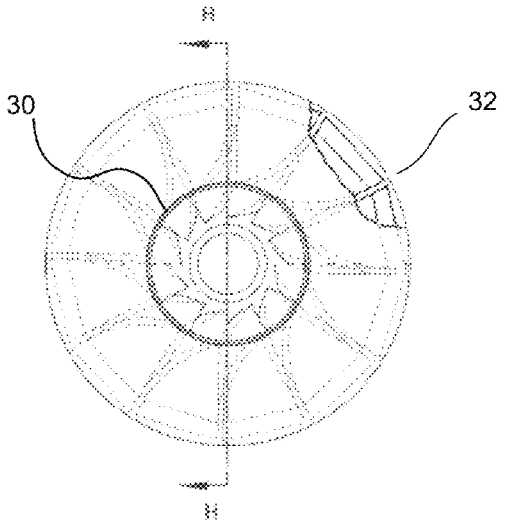
FIGS. 6A-B show a top view and side cross sectional view along section H-H of the impeller blade.
Figure 6B:
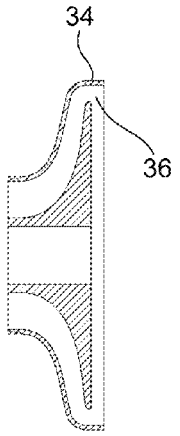
Figure 7:
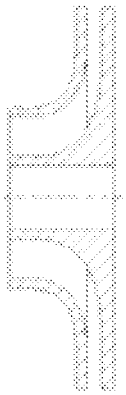
FIG. 7 (Prior Art)
FIG. 7 illustrates an impeller blade and shroud in accordance with prior art shroud design.

As shown by example in FIG. 5, the impeller vanes 26 can be enshrouded by a shroud portion 28, wherein the shroud and the vanes of the impeller define a fluid flow chamber. The vane entry angle 30 can be determined by normal impeller design methods for optimization of the pump. The vane exit angle 32 can be selected in a variety of appropriate angles, and in one example can be approximately parallel to the axis of rotation of the impeller (see, for example, FIGS. 6A and 6B). FIG. 7 illustrates an exemplary vane exit angle that has been used in prior art devices.

Referring still to FIG. 5, the shroud portion 28 of the impeller 24 can include two sides, one on the suction (or top) side of the impeller vane and one on an opposite discharge (or bottom) side of the vane. The top side shroud wraps about the impellor, and can include a parallel shroud section 34 (FIG. 6B) that is at least partially parallel to the axis of rotation of the impeller to more efficiently capture the dynamic pressure generated by the impeller. This shroud portion may be extended beyond the end of the impeller vane by a shroud extension portion 36 to improve performance of the pump, or as other conditions may dictate.

Figure 8:
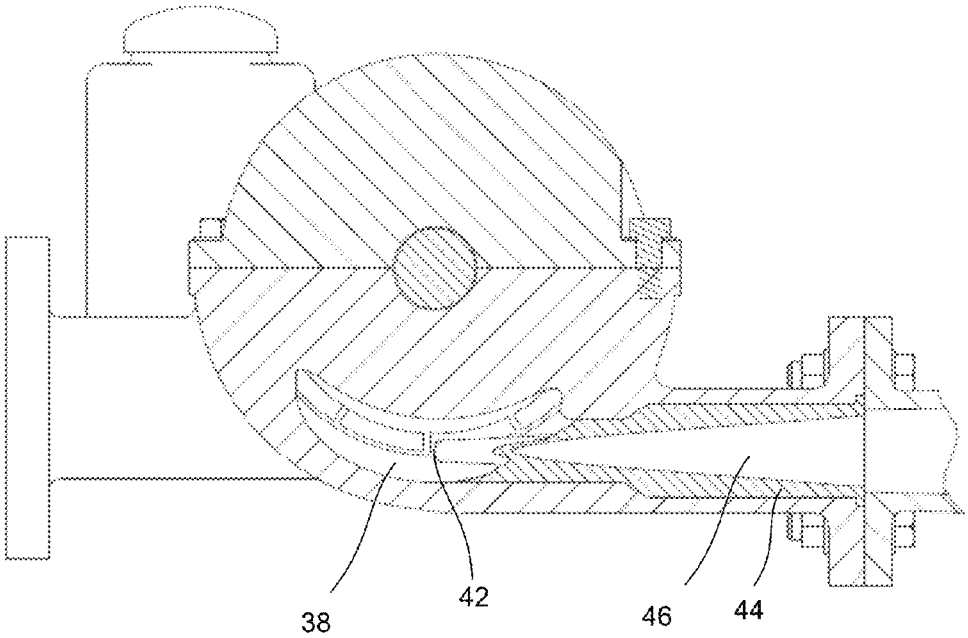
FIG. 8 illustrates a partial cross sectional view of the pitot tube chamber along section G-G of FIG. 1.
Figure 9:
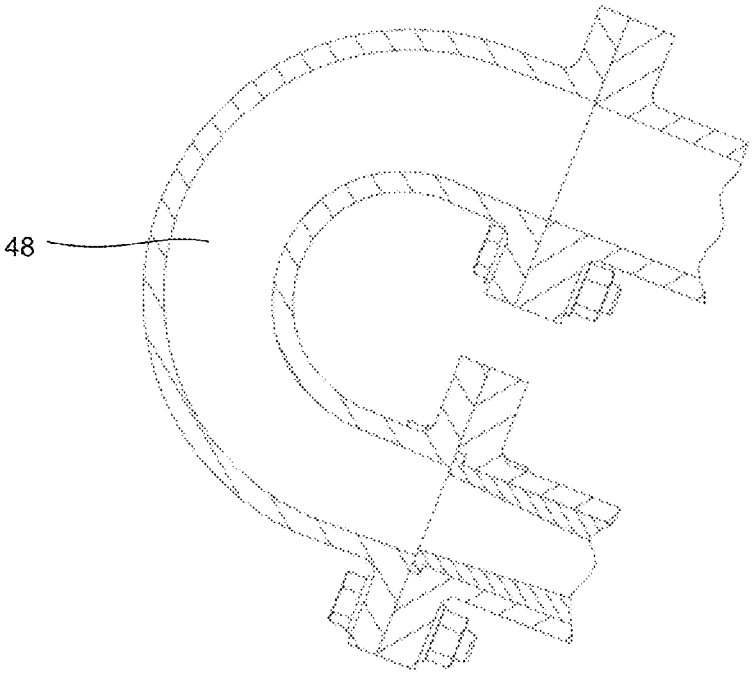
FIG. 9 illustrates a partial cross sectional view of the 180 degree elbow along cross section D-D of FIG. 2.
Figure 10:
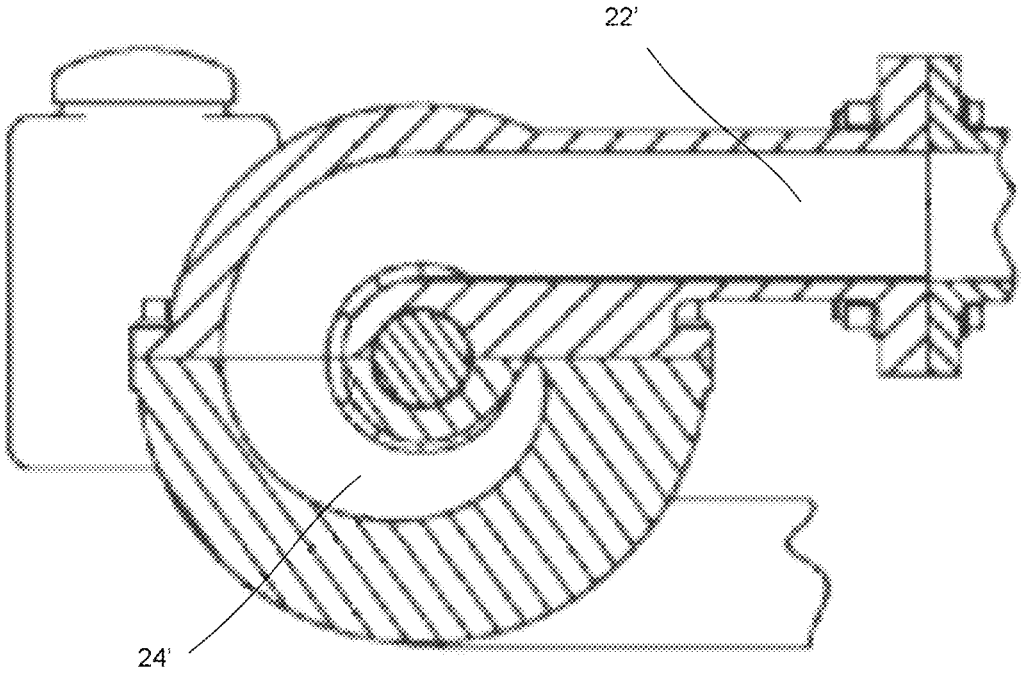
FIG. 10 illustrates a cross sectional view of the second stage of a two stage pump in accordance with one aspect of the present invention which shows a cross sectional view of the pump along section F-F of FIG. 2.
Figure 11:
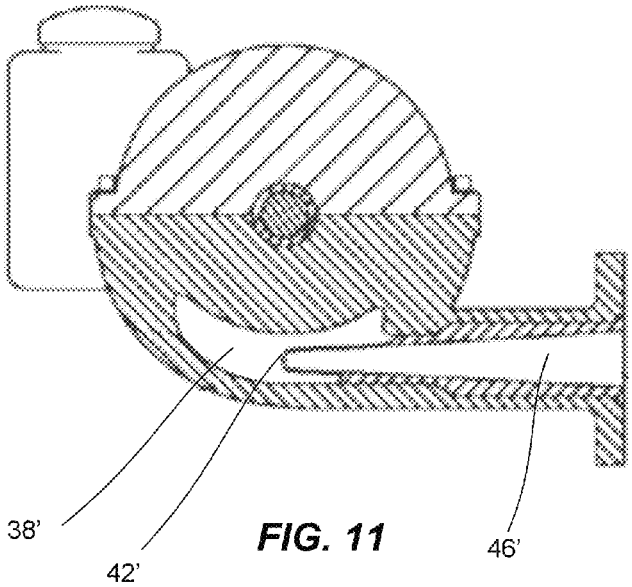
FIG. 11 illustrates a cross sectional view of the pump along the section C-C of FIG. 2.

After the fluid has the dynamic centrifugal energy added to it by the impeller 24, the fluid is then discharged into the pitot tube chamber 38 (see, for example, FIGS. 5, 8, 11, etc.). The fluid flow can be maintained stable by the surrounding geometry of the pitot tube chamber 38, which can be optimized for a particular application. A pitot tube chamber vane 40 can optionally be added that protrudes into the pitot tube chamber 38 for increased stabilization. A pitot tube 44 can be positioned within the pitot tube chamber 38 and can include a pitot tube opening 42 (see, for example, FIGS. 8 and 11).

Pitot tubes operate on the theory and design that any velocity energy or other dynamic centrifugal energy encountered at the area directly around the pitot tube tip is transferred into pressure energy. Thus, openings at the tip of the pitot tube allow fluid to enter at a high pressure with a near zero velocity, allowing for high pressure gradients through the pump at minimized flows. In one embodiment of the present invention, this pitot tube opening 42 can be small relative to the cross section area of the surrounding chamber. The pitot tube chamber 38 can be designed to receive the tip of a pitot tube 44 and introduce the tip of a pitot tube 44. In this manner, the pitot tube opening 42 can be positioned within the pitot tube chamber so as to receive pressure energy from the pump and receive fluid from the pump. The compound pressurized fluid within the pump 10 enters the pitot tube opening 42 and proceeds into a hollow bore within the pitot tube 44 which has a gradually expanding geometry 46 from the tip end to a flange end or output end (see, for example, FIGS. 8, 11, 13A, etc.).

Fluid within the pitot tube 44 can then proceed to the pitot tube output. The interior of the pitot tube can include a continually expanding cross section. The fluid proceeds from the pitot tube 44 itself and into an output connecting pipe 48 (shown by example in FIG. 9 as a 180-degree elbow connecting to a second stage of a two-stage pump). The gradual, uniform expansion of the cross section area of pitot tube 44 stabilizes the flow and minimizes pressure loss due to turbulence.

Figure 12:
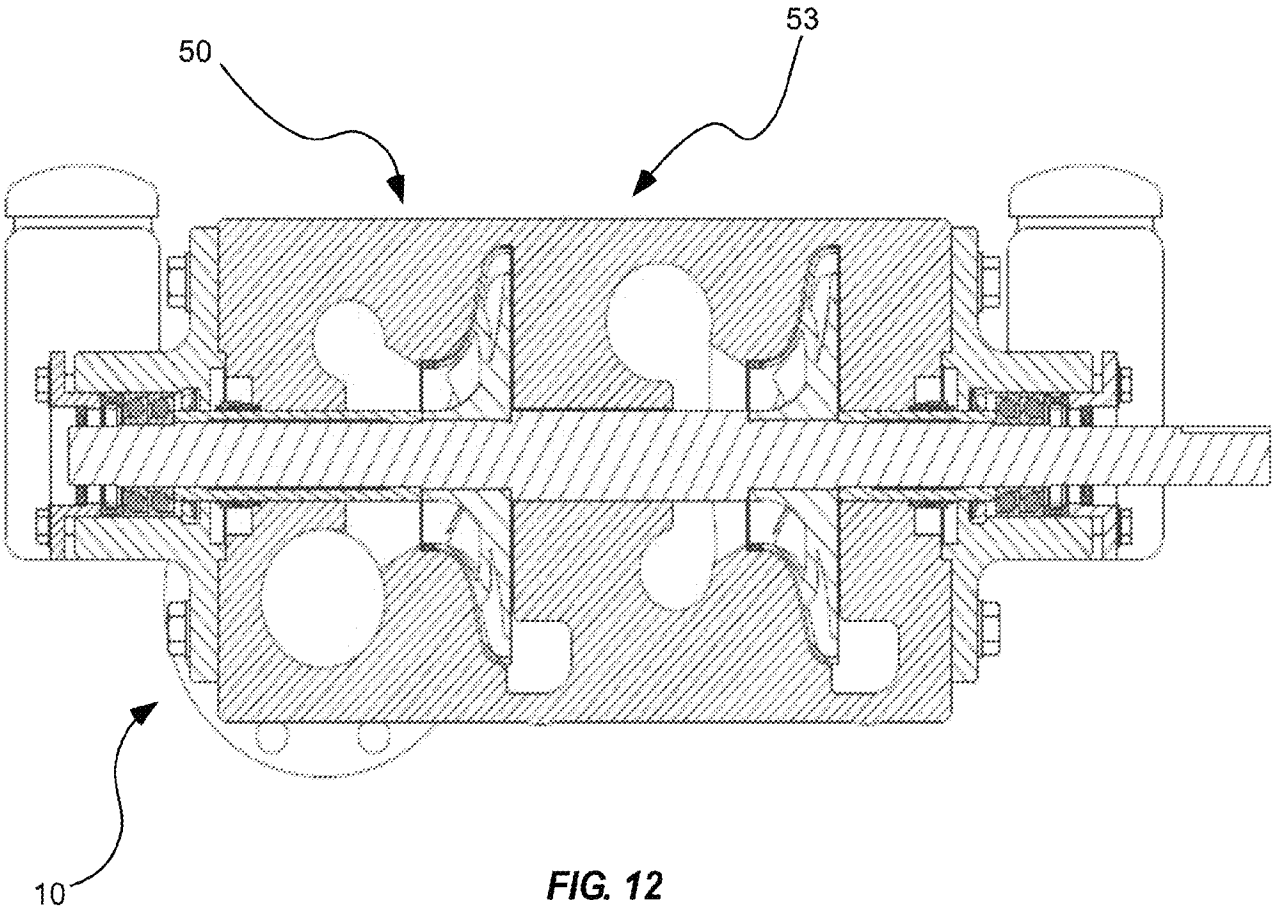
FIG. 12 illustrates a cross sectional view of the pump along the section A-A of FIG. 1 showing the two stages and two impellers of the two stage pump.

In one aspect of the invention, the pump assembly can be configured as a two-stage pump, as shown by example in FIG. 12. In this case, the fluid can proceed to the second stage 50, following a similar flow path and pressure boosting result. The actual output pressure or head of each stage can, in theory, be about twice the pressure developed by the impeller alone. In some embodiments of the invention, however, it has been found that the output is about 1.6 times the theoretical centrifugal impeller capacity (due primarily to mechanical losses).

Figure 13B:
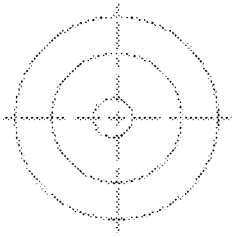
FIG. 13A-B illustrates a pitot tube in accordance with a first embodiment of the present invention.
Figure 13A:
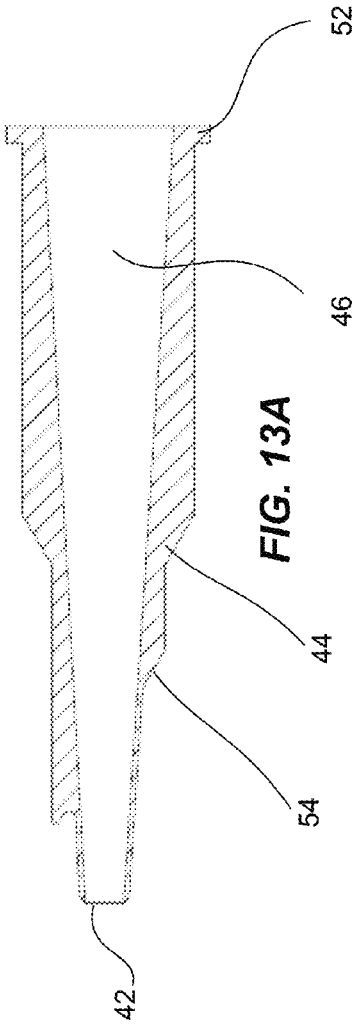

With reference to FIGS. 13A-13B, a pitot tube 42 is shown that can have a singular pitot tube opening 42. The pitot tube opening 42 can be configured to be positioned within the pitot tube chamber (not shown in this figure), wherein the pitot tube opening 42 transitions to a concave chamber 46 within the pitot tube that includes a gradually expanding geometry. The pitot tube 44 may be maintained in position by a flange 52 which can be coupled between a flange of an output connecting pipe and a flange of the pump output, as shown by example in FIGS. 8 and 11.

The flange of the pump output can include an annular groove formed therein that can be configured to receive the flange 52 of the pitot tube. This configuration allows easy service and, if necessary, replacement of the pitot tube 44 by the relatively easy removal of the output connecting pipe rather than by significant disassembly of the fluid casing of the pump. The outer surface of the pitot tube 44 can be tapered to fit within a coinciding concave sleeve of the fluid output pipe formed in the fluid casing of the pump. The pitot tube outer surface can further include an angled forward edge 54 through which the pitot tube tip and opening protrudes. This angled forward edge 54 provides clearance between the pitot tube outer surface and the vanes of the impeller within the pitot tube chamber, as well as providing for an orientation guide upon insertion of the pitot tube 44 into the sleeve during installation or replacement. The clearance between the angled edge 54 and the vanes can be seen in both FIGS. 8 and 11.

In addition to providing a guide for proper orientation and clearance between the pitot tube within the pitot tube chamber, the angled edge 54 also provides for increased support of the pitot tube tip and reduces the risk of tip breakage, particularly along the end of the angled surface which extends toward the pitot tube tip and along the fluid casing of the pump away from the vanes of the impeller.

Figure 14C:
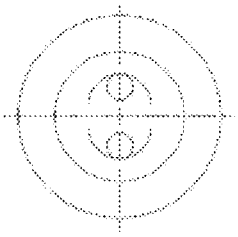
FIG. 14A-C illustrates a pitot tube in accordance with another embodiment of the present invention.
Figure 14A:
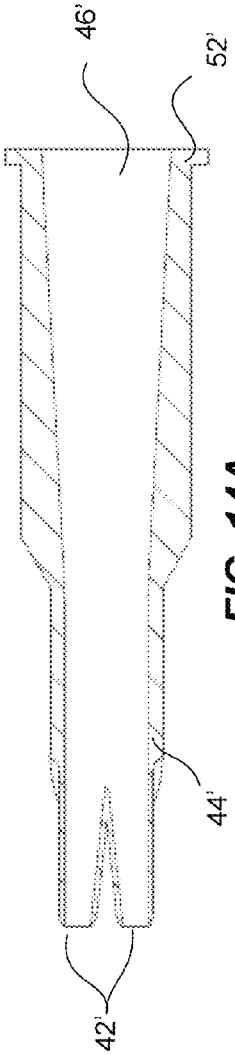
Figure 14B:
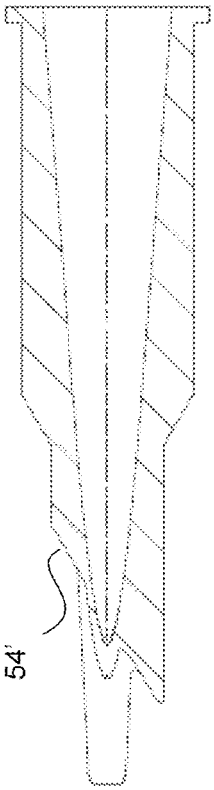

With reference to FIGS. 14A through 14-C, a pitot tube 44' is shown having a plurality of pitot tube openings 42'. Similar to the pitot tube of FIGS. 13A-13B the pitot tube openings 42' are configured to be received by the pitot tube chamber (not shown) wherein the openings 42' allow fluid to pass into a concave chamber 46' within the pitot tube having a gradually expanding geometry. The pitot tube 44' may be maintained in position by a flange 52' which is coupled between a flange of the output connecting pipe and a flange of the pump output, as shown by example in FIGS. 7 and 11. This configuration allows easy service and, if necessary, replacement of the pitot tube 44' by removal of the output connecting pipe (not shown).

Similar to the single opening pitot tube of FIGS. 13A-13B the outer surface of the pitot tube 44' can be tapered to fit within a coinciding concave sleeve of the fluid output pipe formed in the fluid casing of the pump. The pitot tube outer surface may also have an angled forward edge 54' through which the pitot tube tip and opening protrudes. This angled forward edge 54' provides clearance between the pitot tube outer surface and the vanes of the impeller within the pitot tube chamber, as well as providing for an orientation guide upon insertion of the pitot tube 44' into the sleeve during installation or replacement (This clearance can be readily appreciated from FIGS. 8 and 11). Proper orientation of the pitot tube 44' within the pitot tube chamber is critical as misalignment by may result in interference between the wider double hole pitot tube with the impeller.

By providing a plurality of pitot tube openings at the tip of the pitot tube greater flow may be provided and the output volume of the pump may be increased significantly while maintaining nearly the same pressure gradients across each stage.

FIG. 12 depicts a cross sectional view of a two stage pump 10 which has a first stage 50, and a second stage 53. The Two stages of the pump can both be equipped with pitot tubes into their respective outlets to further increase the pressure gradient over what a single stage pump may accomplish.

It is to be understood that the arrangements illustrated and discussed herein are illustrative of the application for the principles of the present invention. Numerous modifications and alternative arrangements can be devised without departing from the spirit and scope of the present invention while the present invention has been shown in the drawings and described in connection with the exemplary embodiments(s) of the invention. It will be apparent to those of ordinary skill in the art that numerous modifications can be made without departing from the principles and concepts of the invention as set forth in the examples.

I claim:

1. A centrifugal pump, comprising:

a pump assembly, through which a fluid can be impelled, the pump assembly including:

a fluid inlet and a fluid outlet;

a fluid casing;

an impeller positioned within the fluid casing, the impeller being driven by a power source and being operable to generate fluid flow within the fluid casing from the fluid inlet to the fluid outlet;

a fluid flow chamber defined between the impeller and the fluid casing, the fluid flow chamber receiving fluid pressurized by movement of the impeller;

at least one pitot tube chamber formed on a periphery of the fluid casing, the pitot tube chamber extending away from the fluid flow chamber and being operable to receive fluid from the fluid flow chamber;

a pitot tube having an outer surface and a tip with at least one opening formed within the tip, the tip being positioned within the pitot tube chamber such that pressurized fluid within the pitot tube chamber can flow around the tip and the outer surface of the pitot tube, the pitot tube being thereby operable to receive pressurized fluid from the pitot tube chamber and pass the fluid through an outlet having a gradually expanding geometry; and a shroud, positioned about the impeller, the impeller and the shroud collectively defining the fluid flow chamber, and wherein an output of the fluid flow chamber to the pitot tube chamber is substantially parallel to an axis of rotation of the impeller.

2. The pump of claim 1, wherein the pitot tube further comprises a flange configured to be sandwiched between an output flange of the pump and a connector output pipe.

3. The pump of claim 1, wherein the pitot tube chamber is formed in an outer portion of the fluid casing so as to not interfere with fluid flow within the fluid flow chamber.

4. The pump of claim 1, wherein the pitot tube includes a hollow bore having a substantially linear geometry having no turns or bends.

5. The pump of claim 1, wherein the pitot tube includes a plurality of openings located on a tip of the pitot tube that allow fluid to enter into a hollow bore within the pitot tube.

6. The pump of claim 1, wherein the pitot tube further comprises:

a tip end;

an output end opposite the tip end;

an annular pitot tube flange formed about the output end of the pitot tube;

wherein the annular pitot tube flange is received in an annular bore in the fluid casing of the pump and is configured to position the tip end of the pitot tube within the pitot tube chamber of the pump, and wherein the pitot tube is maintained in position by an output connecting pipe.

7. The pump of claim 1, further comprising a second pitot tube chamber formed on the periphery of the fluid casing, and a second pitot tube positioned within the second pitot tube chamber to thereby form an additional stage of a multiple stage pump.

8. The pump of claim 1, further comprising a pitot tube chamber vane positioned with the pitot tube chamber.

9. The pump of claim 1, further comprising an angled forward edge formed on the outer surface of the pitot tube, the forward edge being configured to provide clearance between an outer surface of the pitot tube and the impeller.

10. A method of increasing the pressure of a fluid flow device comprising:

obtaining a pump having a fluid casing and an impeller and a fluid flow chamber defined between the casing and the impeller;

forming a pitot tube chamber in a periphery of the fluid casing, the pitot tube chamber extending away from the fluid flow chamber so as to receive fluid from the fluid flow chamber; and placing a tip of a substantially linear pitot tube within the pitot tube chamber such that pressurized fluid within the pitot tube chamber can flow around the tip and an outer surface of the pitot tube, the pitot tube having at least one tip opening passing into an internal pitot tube bore within the pitot tube chamber, the pitot tube bore leading to an output connecting pipe; wherein the fluid device includes a shroud formed over the impeller, wherein a plurality of vanes of the impeller and the shroud collectively form the fluid flow chamber; wherein an output of the fluid flow chamber discharges fluid into the pitot tube chamber in a direction substantially parallel to an axis of rotation of the impeller.

11. The method of claim 10, further comprising:

forming an output flange on an output end of the pitot tube; and coupling the output flange between an output of the pump and the output connecting pipe.

12. The method of claim 11, further comprising:

forming an annular bore in a surface of an outlet of the pump, the annular bore being configured to receive the output flange of the pitot tube.

13. The method of claim 10, further comprising:

forming a pitot tube chamber vane on an interior surface of the pitot tube chamber.

14. The method of claim 10, wherein;

a bore of the pitot tube includes a gradually expanding geometry when moving from a tip end of the pitot tube to an output end of the pitot tube.

15. The method of claim 10, further comprising:

providing at least one additional pitot tube chamber in the periphery of the fluid casing of the pump corresponding to an additional stage of the pump;

providing at least one additional pitot tube for each additional pitot tube chamber.

16. The method of claim 10, wherein;

the pitot tube tip includes a plurality of pitot tube openings.

17. A centrifugal pump comprising:

a fluid casing;

an impeller within the casing configured to provide energy to a fluid passing through the pump;

a shroud positioned over the impeller with a fluid flow chamber formed between the shroud and a plurality of vanes of the impeller;

a pitot tube chamber formed on a periphery of the casing, the pitot tube chamber being in fluid communication with the fluid flow chamber such that an output of the fluid flow chamber discharges fluid into the pitot tube chamber in a direction substantially parallel to an axis of rotation of the impeller;

a substantially linear pitot tube positioned such that a tip of the pitot has at least one tip opening oriented within the pitot tube chamber such that pressurized fluid within the pitot tube chamber can flow around the tip and an outer surface of the pitot tube;

the pitot tube comprising:

a central bore in fluid communication with the tip opening, the central bore having a gradually expanding geometry when moving from a tip end to an output end; and an annular output flange formed about the output end of the pitot tube;

a pump outlet having a flange and an annular bore formed therein configured to receive the annular output flange of the pitot tube; and an output connecting pipe having a pipe flange configured to sandwich the annular output flange of the pitot tube into the annular bore.

18. The pump of claim 17, wherein the pitot tube has a plurality of tip openings.

* * * * *